US005301641A

United States Patent [19]

Kasai et al.

[11] Patent Number: 5,301,641

[45] Date of Patent: Apr. 12, 1994

[54] INTERNAL COMBUSTION ENGINE

[75] Inventors: Hiroshi Kasai, Tokyo; Mitsuo Shiga, Saitama; Takashi Ihara, Tokyo, all of Japan

[73] Assignee: Honda Giken Kogyo Kabushiki Kaisha, Tokyo, Japan

[21] Appl. No.: 972,000

[22] Filed: Nov. 6, 1992

[30] Foreign Application Priority Data

Nov. 6, 1991 [JP] Japan ..... 3-318479
Nov. 6, 1991 [JP] Japan ..... 3-318480

[51] Int. Cl.[5] ..... F02F 1/24
[52] U.S. Cl. ..... 123/193.5
[58] Field of Search ..... 123/193.5, 193.3, 188.2, 123/188.3

[56] References Cited

U.S. PATENT DOCUMENTS 4,793,297 12/1988 Fujii et al. ..... 123/193.5
4,884,539 12/1989 Ciccarone et al. ..... 123/193.5
5,080,057 1/1992 Batzill et al. ..... 123/193.5
5,121,718 6/1992 Saito ..... 123/193.5
5,123,385 6/1992 Sado et al. ..... 123/193.5
5,127,379 7/1992 Kobayashi et al. ..... 123/193.5
5,138,989 8/1992 Fraidl et al. ..... 123/193.5
5,148,781 9/1992 Piatti ..... 123/193.5

*Primary Examiner*—Tony M. Argenbright
*Assistant Examiner*—M. Macy
*Attorney, Agent, or Firm*—Howard L. Rose

[57] ABSTRACT

An air-cooled internal combustion engine has a cylinder block, a piston slidably disposed in a cylinder in the cylinder block, and a cylinder head mounted on the cylinder block and having a partly spherical combustion chamber aligned with the cylinder. An intake valve, an exhaust valve, and a spark plug which are mounted in the cylinder head are oriented radially outwardly from the axis of the cylinder and angularly spaced from each other by distances that are progressively increased in the direction along the axis of the cylinder. The intake valve, the exhaust valve, and the spark plug have respective central axes inclined at the same angle to the axis of the cylinder, and the intake valve, the exhaust valve, and the spark plug are angularly spaced at equal angular intervals as viewed along the axis of the cylinder.

11 Claims, 3 Drawing Sheets

INTERNAL COMBUSTION ENGINE

BACKGROUND OF THE INVENTION

1. Field of the Invention

The present invention relates to an internal combustion engine.

2. Description of the Prior Art

There are known air-cooled engines having partly spherical combustion chambers which house the valve heads of intake and exhaust valves that are movably supported in the cylinder head.

If the intake and exhaust valves are positioned closely to each other, then they tend to disturb a flow of cooling air applied to the engine. Therefore, the flow of cooling air cannot efficiently cool the intake and exhaust valves and a spark plug that is located near the intake and exhaust valves.

Japanese laid-open patent publication No. 53-11205 discloses an engine having a partly spherical combustion chamber. The disclosed engine also has an intake valve, an exhaust valve, and a spark plug that face into the combustion chamber. The intake and exhaust valves are inclined at the same angle with respect to the axis of the cylinder bore.

In the disclosed engine, however, the spark plug is mounted in the cylinder head at an angle different from the angle of the intake and exhaust valves. Therefore, holes for receiving the intake valve, the exhaust valve, and the spark plug have to be defined in the cylinder head at different angles. To form such holes in the cylinder head with a drilling machine, it is necessary to change the angle of the cylinder head with respect to the drill bit or the angle of the drill bit with respect to the cylinder head each time a cylinder head is to be drilled by the drill bit. Consequently, it has been difficult, time-consuming, and costly to manufacture the disclosed engine.

OBJECTS OF THE INVENTION

It is an object of the present invention to provide an internal combustion engine having intake and exhaust valves positioned and oriented to define a relatively wide area or space for the smooth passage of a flow of cooling air for cooling the intake and exhaust valves efficiently.

Another object of the present invention is to provide an internal combustion engine that can be manufactured easily and inexpensively within a short period of time.

BRIEF DESCRIPTION OF THE PRESENT INVENTION

According to the present invention, there is provided an internal combustion engine comprising a cylinder block having a cylinder having an axis, a piston slidably disposed in the cylinder, a cylinder head mounted on the cylinder block and having a partly spherical combustion chamber aligned with the cylinder, an intake valve mounted in the cylinder head and having a valve head disposed in the combustion chamber, and an exhaust valve mounted in the cylinder head and having a valve head disposed in the combustion chamber, the intake valve and the exhaust valve being oriented radially outwardly from the axis of the cylinder and angularly spaced from each other by distances that are progressively increased in a direction away from the cylinder block along the axis of the cylinder.

The internal combustion engine further includes a spark plug mounted in the cylinder head and having electrodes disposed in the combustion chamber, the spark plug being oriented radially outwardly from the axis of the cylinder and angularly spaced from each of the valves by distances that are progressively increased in the direction along the axis of the cylinder.

The intake valve, the exhaust valve, and the spark plug may have respective central axes inclined at the same angle to the axis of he cylinder, and the intake valve, the exhaust valve, and the spark plug may be angularly spaced at equal angular intervals circumferentially about the axis of the cylinder.

According to the present invention, there is also provided an air-cooled internal combustion engine comprising a cylinder block having a cylinder having an axis, a piston slidably disposed in the cylinder, a cylinder head mounted on the cylinder block and having a partly spherical combustion chamber aligned with the cylinder, an intake valve mounted in the cylinder head and having a valve head disposed in the combustion chamber, an exhaust valve mounted in the cylinder head and having a valve head disposed in the combustion chamber, and a spark plug mounted in the cylinder head and having electrodes disposed in the combustion chamber, the intake valve, the exhaust valve, and the spark plug being oriented radially outwardly from the axis of the cylinder and angularly spaced from each other by distances that are progressively increased in the direction along the axis of the cylinder. In the air-cooled internal combustion engine, the intake valve, the exhaust valve, and the spark plug may have respective central axes inclined at the same angle to the axis of the cylinder, and the intake valve, the exhaust valve, and the spark plug may be angularly spaced at equal angular intervals as viewed along the axis of the cylinder.

According to the present invention, there is further provided an internal combustion engine comprising a cylinder block having a cylinder having an axis, a piston slidably disposed in the cylinder, a cylinder head mounted on the cylinder block and having a partly spherical combustion chamber aligned with the cylinder, an intake valve mounted in the cylinder head and having a valve head disposed in the combustion chamber, an exhaust valve mounted in the cylinder head and having a valve head disposed in the combustion chamber, and a spark plug mounted in the cylinder head and having electrodes disposed in the combustion chamber, the intake valve, the exhaust valve, and the spark plug having respective central axes inclined at the same angle to the axis of the cylinder, and the intake valve, the exhaust valve, and the spark plug being angularly spaced at equal angular intervals as viewed along the axis of the cylinder. The intake valve, the exhaust valve, and the spark plug may be oriented radially outwardly from the axis of the cylinder and angularly spaced from each other by distances that are progressively increased in the direction along the axis of the cylinder.

The above and further objects, details and advantages of the present invention will become apparent from the following detailed description of a preferred embodiment thereof, when read in conjunction with the accompanying drawings.

DETAILED DESCRIPTION OF THE PREFERRED EMBODIMENT

Figure 1:
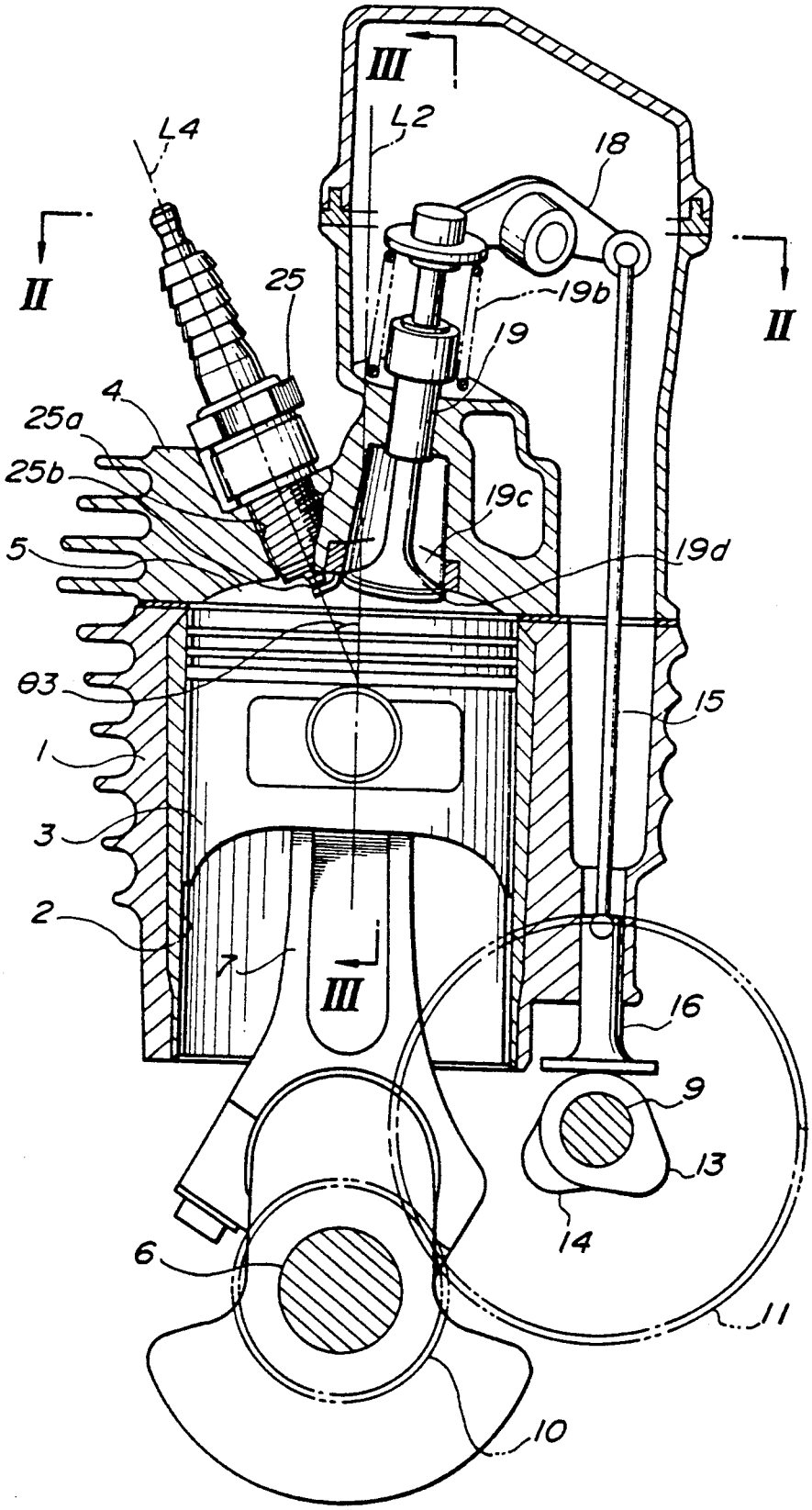
FIG. 1 is a vertical cross-sectional view of an internal combustion engine according to the present invention.

FIG. 1 shows an internal combustion engine embodying the present invention, the internal combustion engine typically comprising an air-cooled internal combustion engine. As shown in FIG. 1, the internal combustion engine includes a cylinder block 1 having a cylinder 2 defined therein, a piston 3 slidably disposed in the cylinder 2, and a cylinder head 4 mounted on the cylinder block 1 and having a partly spherical combustion chamber 5 defined therein and opening toward the piston 3 in the cylinder 2 in alignment therewith. The internal combustion engine also has a crankshaft 6 operatively connected to the piston 3 by a connecting rod 7. The crankshaft 6 supports thereon a concentric gear 10 which is held in mesh with a gear 11 fixedly mounted on a shaft 9 that is positioned laterally of and extends parallel to the crankshaft 6.

Cams 13, 14 are fixedly mounted on the shaft 9. The cam 13 is held in sliding contact with a tappet 16 mounted on the lower end of a vertical pushrod 15. The pushrod 15 has an upper end coupled to one end of a rocker arm 18 whose other end is coupled to the upper end of an intake valve 19. The intake valve 19 is mounted in the cylinder head 4 and is normally biased by a coil spring 19*b* to close an intake port 19*c* which is defined in the cylinder head 4 and opening into the combustion chamber 5. The cam 14 is held in sliding contact with a tappet mounted on the lower end of another vertical pushrod 20 (see FIG. 2). The pushrod 20 has an upper end coupled to one end of a rocker arm 22 whose other end is coupled to the upper end of an exhaust valve 23. The intake valve 23 is mounted in the cylinder head 4 and is normally biased by a coil spring 23*b* to close an exhaust port 23*c* (see FIG. 3) which is also defined in the cylinder head 4 and opening into the combustion chamber 5.

The intake and exhaust valves 19, 23 have respective valve heads 19*d*, 23*d* positioned in the combustion chamber 5 for selectively opening and closing the intake and exhaust ports, respectively.

A spark plug 25 is mounted in the cylinder head 4 and has electrodes 25*b* disposed in the combustion chamber 5.

Figure 3:
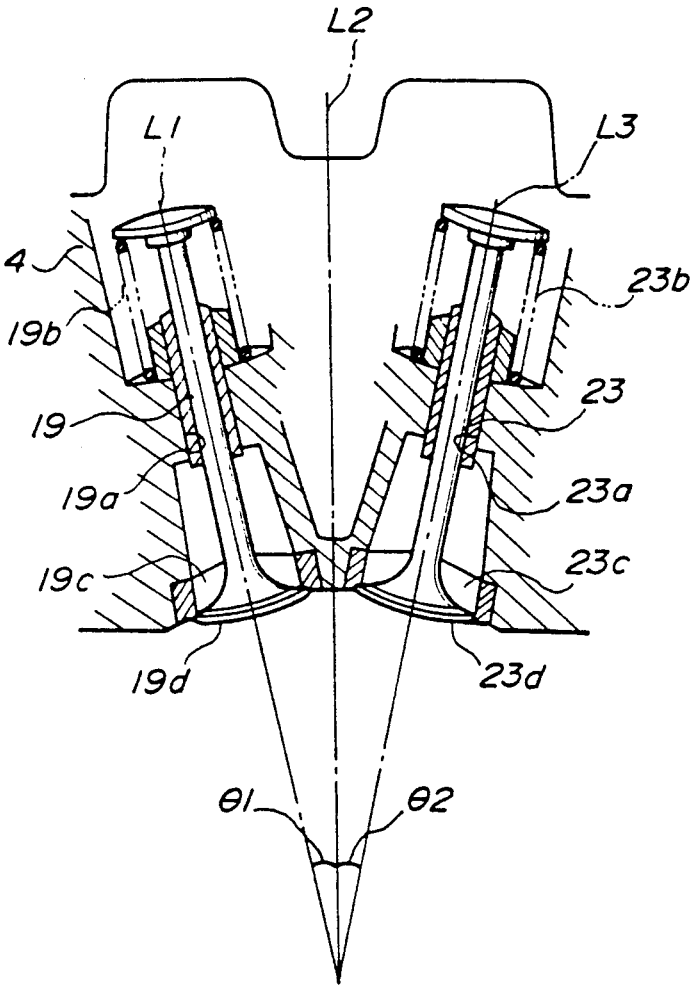
FIG. 3 is a cross-sectional view taken along line III—III of FIG. 1.

The intake valve 19, the exhaust valve 23, and the spark plug 25 are inclined at the same angle to the cylinder head 4. More specifically, as shown in FIG. 3, the intake valve 19 has a central axis L1 which is inclined at an angle $\theta 1$ to the axis L2 of the bore of the cylinder 2, and the exhaust valve 23 has a central axis L3 which is inclined at an angle 02 to the axis L2 of the bore of the cylinder 2. As shown in FIG. 1, the spark plug 25 has a central axis L4 which is inclined at an angle $\theta 3$ to the axis L2 of the bore of the cylinder 2. These angles $\theta 1$, $\theta 2$, $\theta 3$ are equal to each other.

Figure 2:
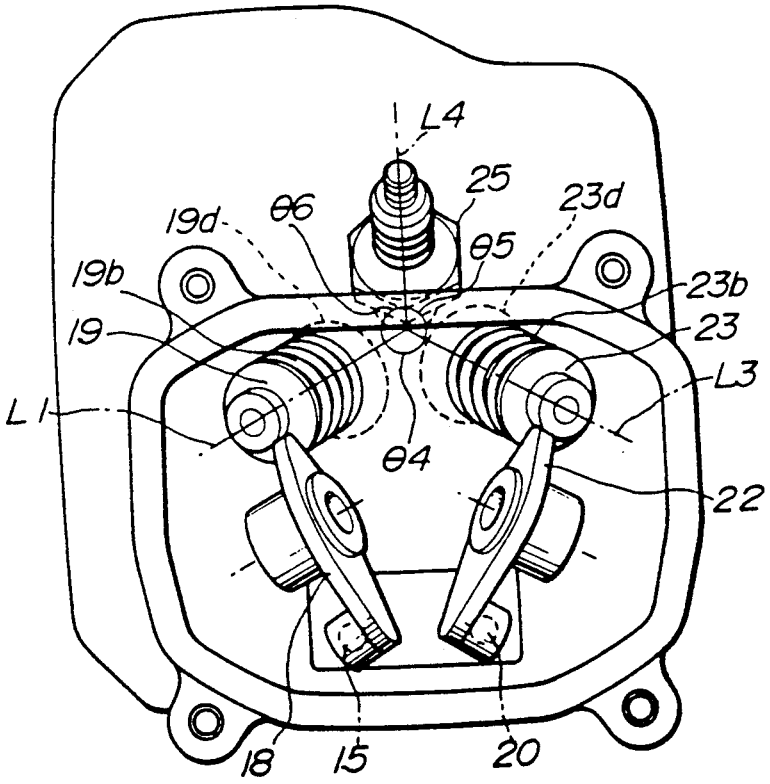
FIG. 2 is a cross-sectional view taken along line II—II of FIG. 1.

When the intake valve 19, the exhaust valve 23, and the spark plug 25 are viewed along the cylinder bore axis L2, as shown in FIG. 2, they are angularly spaced at equal angular intervals. Specifically, the axes L1, L3 are inclined at an angle $\theta 4$ of 120° relative to each other, the axes L3, L4 are inclined at an angle $\theta 5$ of 120° from each other, and the axes L4, L1 are inclined at angle $\theta 5$ of 120° from each other.

Therefore, the intake valve 19, the exhaust valve 23, and the spark plug 25 are oriented radially outwardly from the axis L2 of the cylinder bore, and the distances between the intake valve 19, the exhaust valve 23, and the spark plug 25 are progressively increased in the upward direction. This arrangement provides a sufficient space between the intake valve 19, the exhaust valve 23, and the spark plug 25 for the smooth passage of a flow of cooling air to cool the intake valve 19, the exhaust valve 23, and the spark plug 25 efficiently. Since the intake valve 19 and the exhaust valve 23 are spaced from the spark plug 25, the spark plug 25 can be accessed and serviced easily for maintenance or replacement.

When the internal combustion engine is manufactured, it is possible to define attachment holes 19*a*, 23*a*, 25*a* (see FIGS. 1 and 3) successively in the cylinder head 4 with a drill bit while indexing the cylinder head 4 about the axis L2. Consequently, the cylinder head 4 can be machined easily and inexpensively within a short period of time.

Although there has been described what is at present considered to be the preferred embodiment of the invention, it will be understood that the invention may be embodied in other specific forms without departing from the essential characteristics thereof. The present embodiment is therefore to be considered in all respects as illustrative, and not restrictive. The scope of the invention is indicated by the appended claims rather than by the foregoing description.

What is claimed is:

1. An air-cooled internal combustion engine comprising:
   - a cylinder block having a cylinder having a central longitudinal axis;
   - a piston slidably disposed in said cylinder;
   - a cylinder head mounted on said cylinder block and having a partly spherical combustion chamber aligned with said cylinder;
   - an intake valve mounted in said cylinder head and having a valve head disposed in said combustion chamber;
   - an exhaust valve mounted in said cylinder head and having a valve head disposed in said combustion chamber; and
   - a spark plug mounted in said cylinder head and having electrodes disposed in said combustion chamber;
   - said intake valve, said exhaust valve, and said spark plug being oriented radially outwardly from said axis of the cylinder and angularly spaced from each other by distances that are progressively increased in a direction away from said cylinder head relative to said axis of the cylinder.

2. An air-cooled internal combustion engine according to claim 1, wherein said intake valve, said exhaust valve, and said spark plug have respective central axes inclined at the same angle to said axis of the cylinder, and said intake valve, said exhaust valve, and said spark plug are angularly spaced at equal angular intervals as viewed along said axis of the cylinder.

3. An internal combustion engine comprising:
   - a cylinder block having a cylinder having a central longitudinal axis;
   - a piston slidably disposed in said cylinder;
   - a cylinder head mounted on said cylinder block and having a partly spherical combustion chamber aligned with said cylinder;

an intake valve mounted in said cylinder head and having a valve head disposed in said combustion chamber;

an exhaust valve mounted in said cylinder head and having a valve head disposed in said combustion chamber; and a spark plug mounted in said cylinder head and having electrodes disposed in said combustion chamber;

said intake valve, said exhaust valve, and said spark plug having respective central axes inclined at the same angle to said axis of the cylinder, and said intake valve, said exhaust valve, and said spark plug being angularly spaced at equal angular intervals as viewed along said axis of the cylinder.

4. An internal combustion engine according to claim 3 wherein said intake valve, said exhaust valve, and said spark plug are oriented radially outwardly from said axis of the cylinder and angularly spaced from each other by distances that are progressively increased in a direction away from said cylinder head relative to said axis of the cylinder.

5. An internal combustion engine comprising:

a cylinder block having a cylinder having a central longitudinal axis;

a piston slidably disposed in said cylinder;

a cylinder head mounted on said cylinder block and having a partly spherical combustion chamber aligned with said cylinder;

an intake valve mounted in said cylinder head and having a valve head disposed in said combustion chamber; and an exhaust valve mounted in said cylinder head and having a valve head disposed in said combustion chamber;

a spark plug mounted in said cylinder head and having electrodes disposed in said combustion chamber, said spark plug and one of said valves being oriented radially outwardly from said axis of the cylinder and angularly spaced from each other by a distance that is progressively increased in a direction away from said cylinder block relative to said axis of the cylinder.

6. The internal combustion engine according to claim 5, said engine being an air-cooled engine.

7. A cylinder head for mounting on a cylinder block having a cylinder with a central longitudinal axis comprising:

a cylinder head having a partially spherical combustion chamber alignable with a cylinder;

a first passage in said cylinder head for receiving an intake valve;

a second passage in said cylinder head for receiving an exhaust valve;

a third passage in said cylinder head for receiving a spark plug;

at least one of said first and second passages and said third passage being oriented radially outward from the axis of the cylinder when mounted on the cylinder block and angularly spaced from each other by a distance that is progressively increased in a direction away from said partially spherical combustion chamber.

8. A cylinder head according to claim 7 wherein all of said passages are angularly spaced from each other by distances that are progressively increased in a direction away from said partially spherical combustion chamber relative to the axis of a cylinder when the cylinder head is mounted on the cylinder block.

9. A cylinder head according to claim 8 wherein all of said passages are inclined at the same angle relative to the axis of the cylinder.

10. A cylinder head according to claim 8 wherein said passages are angularly spaced at equal angular intervals about the axis of the cylinder.

11. A cylinder head according to claim 10 wherein all of said passages are inclined at the same angle relative to the axis of the cylinder.

* * * * *